United States Patent [19]

Herzfeld et al.

[11] Patent Number: 4,634,053

[45] Date of Patent: Jan. 6, 1987

[54] HANDLE FOR A FLUIDIC CLEANING AND/OR MASSAGING DEVICE

[75] Inventors: Ronald Herzfeld, Germering; Karl Wydra, Oberhaindlfing; Alexander Uebel, Stanggass, all of Fed. Rep. of Germany

[73] Assignee: Knorr-Bremse Fluidics GmbH, Munich, Fed. Rep. of Germany

[21] Appl. No.: 705,879

[22] Filed: Feb. 26, 1985

Related U.S. Application Data

[63] Continuation-in-part of Ser. No. 443,881, Nov. 23, 1982, abandoned.

[30] Foreign Application Priority Data

Nov. 28, 1981 [DE] Fed. Rep. of Germany ..... 3147264

[51] Int. Cl.[4] ..... B05B 7/00

[52] U.S. Cl. ..... 239/315; 137/268

[58] Field of Search ..... 239/310, 315; 137/268; 422/261, 263, 264, 274, 278

[56] References Cited

U.S. PATENT DOCUMENTS

| | | | |
|---|---|---|---|
| 563,195 | 6/1896 | Lyon | 239/315 |
| 1,260,777 | 3/1918 | Kirkegaard | 422/278 |
| 1,388,136 | 8/1921 | Whitney | 422/274 |
| 1,469,065 | 9/1923 | D'Arcy | 422/263 |
| 1,747,834 | 2/1930 | Linck | 422/278 |
| 1,875,411 | 9/1932 | Beebe | 422/263 |
| 2,338,615 | 1/1944 | Armstrong et al. | 239/315 |
| 2,387,944 | 10/1945 | Raymond | 239/310 |
| 2,537,790 | 1/1951 | Sage | 239/315 |
| 2,708,599 | 5/1955 | Grikscheit | 239/315 |
| 3,083,916 | 4/1963 | Neel | 239/315 |
| 3,199,957 | 8/1965 | Vivion | 239/315 |
| 4,353,876 | 10/1982 | Ballu et al. | 239/310 |

*Primary Examiner*—Andres Kashnikow

*Attorney, Agent, or Firm*—W. G. Fasse; D. H. Kane, Jr.

[57] ABSTRACT

A hollow handle (1), which is connected at one end to a water hose (2), and which is connectable at the other end to a fluidic cleaning and/or massaging device, especially a mouth cleansing shower, a face cleaning brush or a denture cleaning device, comprises a dosing space (40) or takes up a separate dosing container (9, 25, 29). An effective substance is located in the dosing space or in the insertable dosing container. The dosing space or the dosing container is provided with a device (11, 27, 35, 36, 42) for dispensing a small, especially an adjustable quantity of the effective substance into the water stream guided through the hollow handle. The effective substance may be solid or liquid. Solid effective substances which are hard to dissolve are preferably shaped as rods which are insertable into a respectively adapted elongated dosing container (9), which is provided with a certain number of holes (14, 14') corresponding to the quantity of the effective substance selected to be dissolved. The water stream in the handle is guided to pass by said holes. When a liquid effective substance is used, it may be sucked out of the dosing container (25, 29) or out of the dosing space (40) by the water stream. For increasing the total time needed for dissolving an effective substance rod (11) in a handle (1) it may be sufficient to insert a flow slide disk (21) into the bottom of the handle. The disk keeps the outflowing water away from the lower facing surface of the rod of the effective substance and it guides the water into the free ring space (24) between the inner wall of the handle (1) and the effective substance.

14 Claims, 14 Drawing Figures

Figure 1:
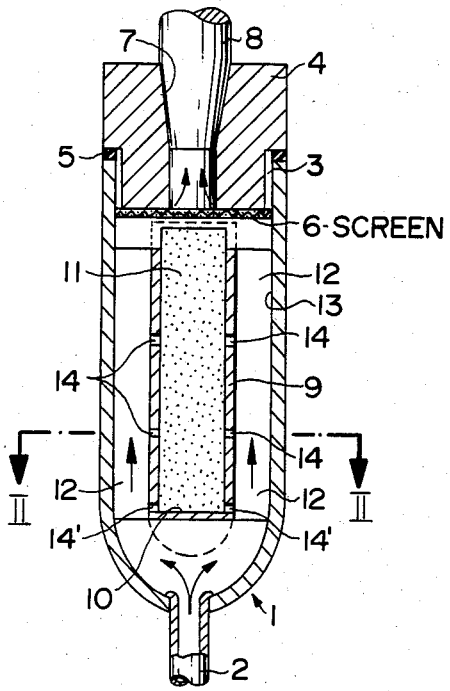

FIG. 7
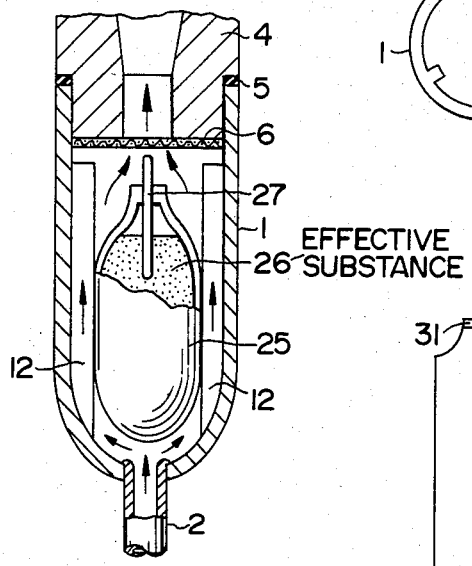
FIG. 8
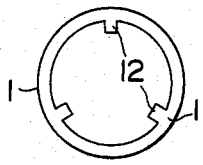
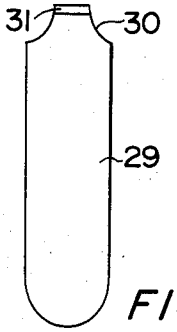
FIG. 10
FIG. 11
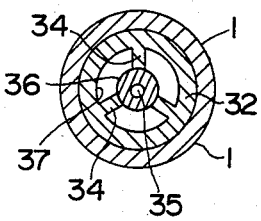
FIG. 9
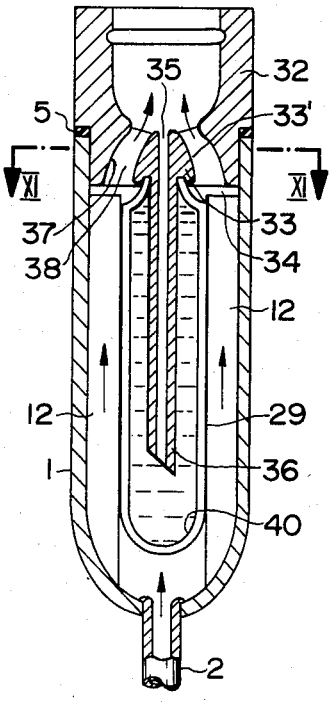
FIG. 12
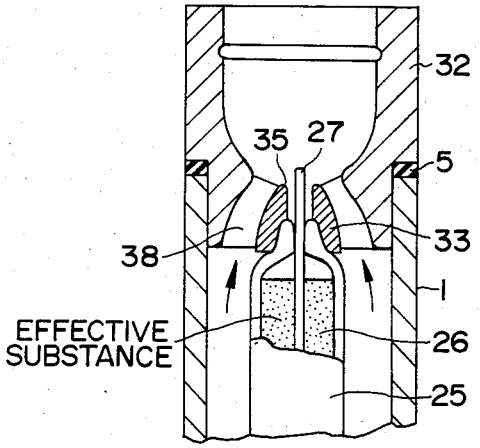

HANDLE FOR A FLUIDIC CLEANING AND/OR MASSAGING DEVICE

CROSS-REFERENCE TO RELATED APPLICATION:

This is a continuation-in-part patent application of our copending patent application U.S. Ser. No. 443,881, filed on Nov. 23, 1982, now abandoned.

BACKGROUND OF THE INVENTION

The invention relates to a hollow handle for a fluidic personal care device for cleaning and/or massaging purposes. The fluidic cleaning and/or massaging device may for instance be a mouth cleaner with or without bristles, a denture cleaning device or a skin cleaning and/or massaging device, especially for facial skin. The same handle may be used for the various devices. The fluidic massaging and/or cleaning device comprises at least one nozzle for the discharge of a water jet. Advantageously, it would comprise a fluidic oscillatory nozzle which discharges an oscillating jet. However, it may also comprise a nozzle which discharges a pulsating jet. The pressurized water source, to which the fluidic massaging and/or cleaning device is connected, may be a water faucet, for instance in a bathroom, or a water container connected to an electric pump.

Solid effective substances, which are difficult to dissolve in the water stream, are well known. It has also already been suggested to form such effective substances into rods and to insert them into the hollow handle of a mouth cleaning device.

OBJECT OF THE INVENTION

In this context the problem arose that the effective substance is acted upon much too irregularly and intensively by the water which flows past it. Thus, the effective substance is used up in a relatively short time, and the amount of the substance dissolved in the water is uncontrolled and too high. In this connection a difficulty also arises in that a rod of the effective substance soon breaks into several pieces, which may block the path of the water flow. If the fluidic cleaning and/or massaging devices being used comprise oscillators which deliver a back and forth oscillating cleaning and/or massaging jet, it is especially important that the oscillators do not become clogged by effective substance pieces.

Furthermore, the problem exists that different effective substances which are characterized by different dissolving rates in the water stream are inserted in one and the same handle, depending on the type of cleaning and/or massaging device to which the handle is coupled. Thus, effective substances used for mouth hygiene dissolve at a different rate in flowing water than effective substances which are used in a denture cleaning device, for instance.

Therefore, it is the object of the invention to indicate means and ways with which the quantity of an effective substance dissolved in the water stream flowing through the handle may be adjusted, so that different effective substances having different dissolving characteristics in flowing water may be inserted in one and the same handle depending on the use of the attached cleaning and/or massaging device.

SUMMARY OF THE INVENTION

The above stated object is achieved according to the invention in that the handle comprises a dosing chamber or dosing container for holding a supply of an effective substance. This dosing chamber or container includes a device for the steady release of the effective substance to the water stream flowing through the handle in a selectable, small quantity.

Advantageous embodiments and further developments according to the invention may be taken from the features of the dependent claims and/or from the following Figure Description of the example embodiments. In this connection the embodiments are distinguished depending on the type of effective substance which may comprise any desired consistency between liquid and solid. In solid form the effective substance may have a powdered or granular consistency or it may be in the shape of tablets or rods. The effective substance may also have a low or a high viscosity or be doughy or pasty. In many cases, it is especially advantageous when it has a rod-shape, which is as difficult to dissolve as possible.

BRIEF FIGURE DESCRIPTION

Figure 2:
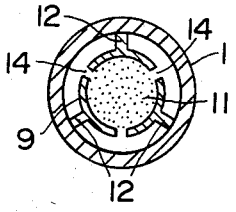
Figure 3:
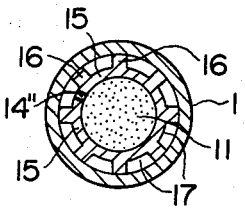
Figure 4:
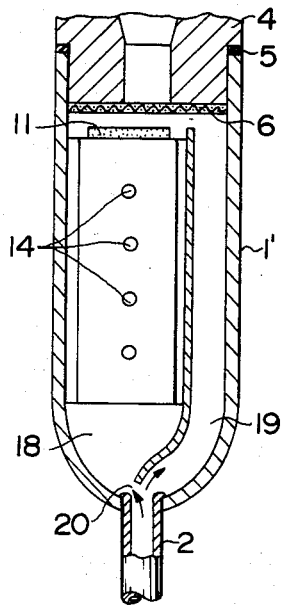
Figure 5:
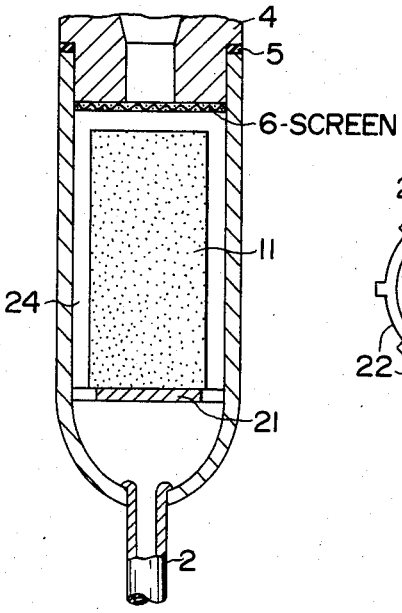
Figure 6:
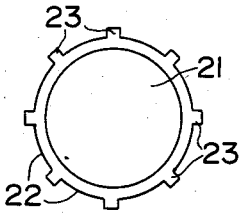
Figure 1A:
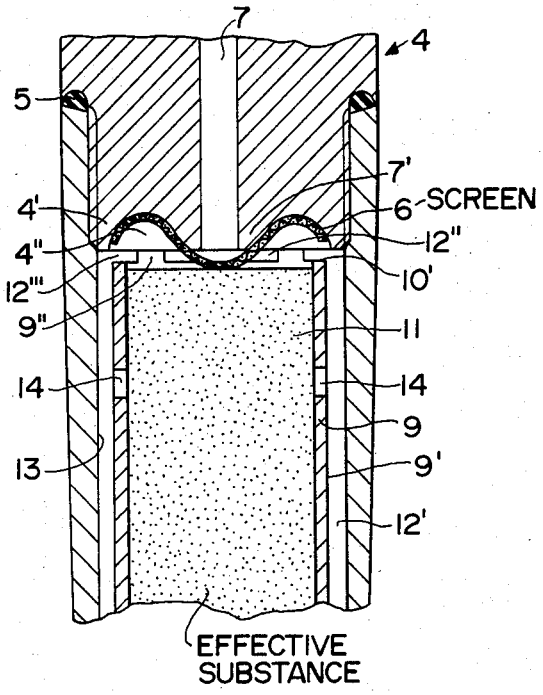

In the drawings, it is shown in an enlarged shematic representation of which:

FIG. 1 is a longitudinal section through a handle for a fluidic cleaning and/or massaging device according to the invention, with an inserted dosing container for holding a solid effective substance rod;

FIG. 1*a* part of a longitudinal section through a further handle according to the invention;

FIG. 2 a section along the lines II—II in FIG. 1;

FIG. 3 a section corresponding to FIG. 2 through a handle according to FIG. 1 with a differently constructed dosing container;

FIG. 4 another handle according to the invention with a bypass for holding the effective substance or a dosing container;

FIGS. 5 and 6 a handle with a stream-guiding disk, which and 6 prolongs the dissolving of an effective substance rod in the base area of the handle; and FIGS. 7 to 13 other handles according to the invention for to 13 liquid effective substances.

DETAILED DESCRIPTION OF PREFERRED EXAMPLE EMBODIMENTS AND OF THE BEST MODE OF THE INVENTION

FIG. 1 shows a longitudinal section through a hollow handle 1 of a fluidic cleaning and/or massaging device, which may, for instance, be a mouth cleaner, a face cleaning shower, or a denture cleaning device, which are not shown here.

The hollow handle 1 is connected at its rear, slightly tapered end to a water hose 2 for supplying water. A closure cap 4 is screwed into an internal threading 3 which is provided at the front, cylindrical end of the handle 1. A seal ring 5 is located between the closure cap 4 and the front face of the handle.

The closure cap 4 carries a screen 6 on its inner end, inside the handle. The closure cap 4 further comprises a central recess 7 for connecting to a mounting tube 8, of which only the rear insertion end is shown. The mounting tube carries on its front end for instance a fluidic oscillator, which constitutes a mouth cleaning device, for instance. The fluidic oscillator may also be combined with a brush, to thereby constitute a fluidic toothush or a special denture cleaning device. The brush y also be of a construction forming a face cleaning d/or face massaging device. The handle 1 may also be nnected in another manner to a cleaning and/or massing device. The attachment of the handle 1 to a aning and/or massaging device by means of the unting tube 8 has been chosen as a possible coupling ample.

The central recess 7 in the closure cap 4 is conically aped in this example. The insertion end of the tube 8 correspondingly conically shaped, so that it is held to cap 4 by the contact friction of the conical plug-in nnection. It is clear that other types of connections ween the tube 8 and the closure cap 4, which need be shown more closely here, are also possible.

A dosing container 9 is inserted in the hollow handle according to the invention. The dosing container 9 mprises a thin-walled sleeve or cartridge, preferably de of man-made material. A solid, rod-shaped effece substance 11, which has in its original form an outer meter which is just slightly smaller than the inner meter of the dosing container 9, is inserted into the sing container. The bottom end of the rod-shaped ective substance rests on the flat, closed base or bot- n 10 of the dosing container 9.

Projections, for example three rib-like projections 12, spaced evenly around the outer circumference of dosing container 9, and brace themselves against the er wall 13 of the hollow handle. The projections 12 of sufficient width to form a flow passage for the ter flowing through the handle to flow between the er wall 13 of the handle 1 and the outer wall of the sing container 9, in order to enter the tube 8 at the per end of the handle 1. The flow passage providing ree space between the outer wall of the dosing conner 9 and the inner wall 13 of the handle is chosen so t the water may drain downwardly after the cleaning d/or massaging device has been used when the presized water source is shut off, and the hose connected the handle is vented.

The dosing container in the example comprises sevl holes 14 past which the water flows. The number d size of the holes is so chosen, that only a predeterned amount of the effective substance 11 is dissolved. is clear that the amount of the solid effective subnce dissolved in the flowing water per unit of time is atively larger the more holes are provided. Dependg on the construction and number of the holes, the ount of an effective substance dissolved per unit of e may be adjusted or dosed. Advantageously, at least e hole 14' is located near the base 10 in the side wall the dosing container 9, whereby it is prevented that ter rests remain in the dosing container 9 and form a mp in which the effective substance would dissolve, er the cleaning and/or massaging device has been ed.

Oval holes, slots, gaps, cracks or a combination of ch perforations may also be used instead of round les. The number and shape of the chosen perforations the dosing container is basically dependent on the bstance composition of the effective substance and its solving characteristics in flowing water. It is advangeous of the dosing container is streamlined on its ttom, upstream-facing end, as shown by dotted lines FIG. 1, so that the water stream is evenly guided to e free annular chamber between the dosing container d the inner wall of the handle.

The dosing container 9 in the form of a cylindrical sleeve is, for example, open at the top end. The upper end of the effective substance rod protrudes slightly from the dosing container. Advantageously, the screen 6 of the closure cap 4 of the handle 1 rests just above the upper end of the effective substance rod, so that the screen 6 acts as a sort of seal of the dosing container 9. The protrusion of the effective substance rod from the dosing container 9 is to prevent that water remains in the upper end area of the dosing container after the device has been used. The dosing container may also be provided with an openable lid as shown by dotted lines, which is easily removable from or hinged relative to the dosing container for refilling the dosing container. The rib-like projections 12 on the dosing container are so arranged as to provide it with a slgiht friction fit in the handle. Since the handle is conically tapered at its bottom, water hose connection end, the bottom end of the dosing container, which is provided with a stream-lined profile, is held a distance away from the bottom handle end. In this way, water may flow unthrottled into the free annular chamber between the container and the inner wall of the handle.

In order to adjust the amount of dissolved effective substance in the flowing water stream, it may also be advantageous if the perforations in the dosing container have a selected water permeability.

In this context, for instance, relatively fine holes or a filter-like element with a determined porosity set into a hole of relatively large cross-sectional area may be used. The expert in the field has many alternative solutions to adjust the dissolved amount of a specific effective substance in the water stream, by adjusting the shape and/or size of the perforations including their water permeability. Also, various measures exist which ensure, to a large degree, that essentially no water remains in the dosing container after the device has been used, so that the effective substance does not dissolve at the wrong time. It is furthermore clear to an expert in the field that the rib-like projections 12 on the dosing container 9 could also be attached to the inner wall of the handle 1 and therefore a ribless dosing container 9 is insertable into the hollow handle, whereby it braces itself against the radially inward protruding tibs and assumes a predetermined friction-fit position.

FIG. 1*a* shows a part of a longitudinal section through a further handle of a preferred example embodiment of the invention in an enlarged manner. The numbers of FIG. 1*a* refer to parts of the embodiment corresponding to the same parts of FIGS. 1, 2 and 3.

The dosing container 9 for holding a supply of the solid rod-shaped effective substance 11 is inserted into the hollow handle 1. The bottom end of the dosing container 9 (not shown) is closed like the dosing container 9 in FIG. 1. The top end 10' of the dosing container 9 is open and forms a leaking opening which is in contact with the water stream passing by, for leaking the effective substance 11 at its top end into the open top end 10' of the dosing container 9.

Several first flow passages 12' are defined between the outer wall 9' of the dosing container 9 and the inner wall 13 of the hollow handle 1. The closure cap 4 forms the upper end of the handle 1. This cap is provided with a central flow channel and is secured to the open end of the handle 1 in the manner shown in FIG. 1. The outer end (not shown) of the closure cap is provided with connecting means as shown in FIG. 1 to connect the closure cap with a personal care device 8 (see FIG. 1).

A flowing interaction region 12'' exists between the inner end 4' of said closure cap 4 and the open end 10' of said handle 1 with the inserted dosing container 9 and the effective substance 11 in the dosing container 9. A second flow passage 12''' connects the first flow passages 12' with the interaction region 12''. The interaction region is formed in such a way that the water flowing from the first to the second flow passages and from the second flow passages into the interaction region 12'' causes the effective substance to dissolve generally in the range of the leaking opening (open top end of the dosing container). The flowing velocities of the water stream in the first flow passages 12' and/or in the second flow passages 12''' are slower than in the interaction region 12'' or the pressure in the first and/or in the second flow passages 12' and 12''' is greater than in the interaction region 12''. Therefore the flowing water is characterized by a vortex flow dissolving the top end of the effective substance in the open top end 10' of the dosing container 9. The flowing velocities or pressures in the first and/or second flowing passages are determined by the solubility of the effective substances in water and/or the capability of receptivity of the effective substance in water.

The screen 6 is secured to the inner end 4' of the closure cap 4 and is formed like a cover so that the screen 6 covers the input end of the flow channel 7 and lies opposite to the leaking opening of the dosing container 9. The central part of said screen is spaced from the inner edge 7' of the input end of the central flow channel 7 of the closure cap, whereby the screen prevents the upper end of the effective substance from closing the input end of the central flow channel 7.

The top end 10' of dosing container 9 comprises first spacer means to space the top end 10' of the dosing container 9 from the inner end 4' of the closure cap with its input end of the flow channel 7. The spacer means are formed by projections 9'' at the top end 10' of the dosing container. The projections 9'' rest on the inner end 4' of the closure cap as shown in FIG. 1*a*.

The spaces between the projections 9'' and the inner end 4' of the closure cap and the top end 10' of the dosing container define the second flow passages 12''' connecting the interaction region with the first flow passages 12'.

When the handle 1 is used, the dosing container 9 and/or the effective substance 11 in the dosing container 9 is moved by the water flow in the direction toward the central part of the screen 6, so that the top end of the effective substance 11 is spaced from the edge 7' of the input end of the central flow channel 7. Therefore the top end of the effective substance 11 can not close the input end of the central flow and water may stream through the screen 6 into the flow channel 7 because the central part of the screen is spaced from the edge 7' of the input end of the flow channel 7.

The handle 1 comprises first and second spacer means 12 located between the inner wall 13 of the handle 1 and the outer wall 9' of the dosing container 9. This spacer means forms the first flow passages 12' for the flow of water between the inner wall 13 of the handle 1 and the outer wall of the dosing container.

The spacer means may be projections which are uniformly distributed over the circumference of the dosing container. In FIG. 1*a* the spacer means 12 are small ribs which generally extend along the elongated outer wall of said dosing container 9. These ribs are formed on the inner wall 13 of the handle 1 or on the outer wall 9' of the dosing container. The dosing container is provided with at least one perforation 14 in the outer wall of the dosing container outside the second spacer means 12. One or more perforations are determined by the selected solution quantity of said effective substance. Furthermore, the perforations 14 are sized and shaped such that the water flowing through the perforations 14 into said dosing container 9 may cause the rod-like effective substance to move against the central part of said screen.

The dosing container 9 generally has a cylindrical inner space for holding the effective substance, wherein the cylindrical inner space has a diameter which is slightly larger than the outer diameter of the rod-like effective substance before coming into contact with water.

The water stream flowing from said interaction region into the flow channel 7 causes a suction effect against said leaking opening so that the rod-like effective substance may move out of the dosing container against the central part of the screen 6. The interaction region is generally defined by an annular space 4'' on the inner end 4' of the closure cap 4 around the inlet opening of the central flow channel 7. The central part of the screen is spaced from the inlet opening of the channel 7 and the edges of the screen are held in the annular space.

The second spacer means 12 have such a small height that the free cross-sectional area of the water hose 2 (FIG. 1) at the rear side of the handle is larger than the free cross-sectional area of the first flow passages 12' between the spacer means 12. Furthermore, the pressure of the water flow in the first flow passages 12' is greater than the pressure of the water flow in the interaction region which is connected with the first flow passages 12 by the second flow passages between the projections 9''. These projections 9'' are part of the ribs generally extending along the entire length of the elongated dosing container and being parallel to the axis of the dosing container 9. But it may be preferable if the ribs on the outer side of the dosing container 9 are formed like a screw.

FIG. 3 shows a modified dosing container. Here the dosing container 9' comprises on its outer surface numerous longitudinal grooves 15 which are defined by ribs 16, and which are evenly spaced around the circumference of the dosing container. These ribs 16 are braced against the inner wall of the handle 1. The free spaces which are defined by the ribs 16 and the opposed inner wall of the handle 1 form a plurality of flow paths 17 for the water flowing past the outside of the container. Holes 14'', through which the water finds a limited access to the effective substance, emerge into the longitudinal grooves 15. Also in this case, the shape and number of the perforations in the wall of the dosing container are determined by the quantity of the effective substance that is desired to be dissolved.

It is not absolutely necessary that the ribs on the dosing container or on the inner wall of the handle provide a friction-fit for the dosing container. It can be sufficient if the ribs or similar projections ensure that the water flowing past can evenly distribute itself over the entire circumference of the dosing container. The ribs must also ensure that not only a certain surface section is exposed to the flowing water, due to a one-sided position of the dosing container against the inner wall of the handle. Minor tumbling movements of the dosing container, of which the laterally protruding ribs end a small distance away from the inner surface of the handle, have no negative effects on the dosing function.

It is clear to the expert in this field, that laterally protruding beads or knobs may be provided instead of the ribs, for the mounting of the dosing container with a clearance from the inner wall of the handle. It can also be sufficient if several projections are limited to the upper and lower portions of the dosing container.

The dosing container may analogously be provided with radial flanges at each end which comprise flow through passages for the substantially unhindered passage of water.

In the example embodiments shown, the dosing containers are located essentially in the center of the handle 1, and define a free annular chamber between a dosing container and the inner wall of the handle 1. The water flows along this annular chamber to the cleaning and/or massaging device.

It is clear to the expert in this field, that the dosing container 9, 9' may be so arranged in the hollow handle 1, that only a partial flow, of the total flow conducted through the handle, flows along the dosing container, whereby the dosing container is located in a bypass. The amount of effective substance entering the bypass flow is adjustable depending on the size of the bypass flow. Thus, a bypass is a further possibility, in addition to the choice of the number and shape of the perforations 14, 14'' in the dosing container 9, 9', to determine the quantity of dissolved effective substance.

An example embodiment of a handle 1' according to the invention is shown in FIG. 4 in a longitudinal section, wherein the dosing container 9 is set in a bypass 18, which is branched off of the main flow path 19. The water volume, which is branched off from the main flow path 19, may be determined according to the choice of the cross-sectional area at the inflow end 20 of the bypass 18.

The flow volume which is directed through the bypass 18 may be chosen to be so small, that it is no longer necessary that the effective substance rod be placed in a special dosing container 9, as is shown in the example embodiments in FIGS. 1 to 3. It may be sufficient, to insert the effective substance rod 11 directly into the bypass 18. In such a case, the bypass 18, with the selected cross-section at its inflow end 20, essentially forms the dosing container or dosing chamber.

FIGS. 5 and 6 show a further handle 1 according to the invention, for the insertion of an effective substance rod 11. Here a thin stream guiding disk 21 is simply rigidly attached in the bottom end of the handle. Around its circumference the stream guiding disk possesses gear wheel-like indentations 22 which are defined by projections 23, which brace themselves against the inner wall at the base of the handle 1. By these means, a number of flow through passages are formed near the wall at the inlet end of the handle. These passages force the water flowing in from the hose 2 to flow along the inner wall of the handle 1. The effective substance rod 11 originally has such a diameter, so that it leaves free a sufficiently wide annular chamber 24, between the rod and the inner wall of the handle, whereby the rod rests with its lower end on the flat streamguiding disk 21, which protects the lower end face of the rod against a direct impingement by the supplied water flow. The total dissolving time of an effective substance rod may be substantially lengthened by these means with a relatively minimal effort. In other words, the amount of the effective substance which is dissolved is substantially less with the insertion of the disk 21 than without it.

It may be advantageous, if the disk 21 is stream-lined on its upstream side, as shown by a dotted line in FIG. 1 for the bottom of the dosing container 9.

FIGS. 7 and 8 show a further handle 1 according to the invention which comprises radially inward projecting ribs 12 on its inner wall, which firmly hold a cartridge-like dosing container 25 in a determined position in the center of handle 1.

In FIG. 7, the dosing container 25 is shown in a partially broken away section. It is essentially filled with a fiberlike material 26, which serves as a reservoir for a liquid effective substance. The fiber-like material 26 is connected with a pin 27, which is absorbent, and which leads out through a constricted neck 28 at the upper end of the dosing container. The upper end 29 of the absorbent pin 27, which protrudes from the dosing container 25, reaches into the flow path of the water, which is delivered through the hose 2 into the handle 1, and which flows along the free annular chamber between the dosing container 25 and the inner wall of the handle 1 to the upper end of the handle 1, where it contacts the absorbent pin end 29, through which the liquid effective substance is transmitted from the fiber-like material to the water in a selectably adjustable amount.

The absorbent pin 27, may be omitted if the fiber type material itself projects out of the opening in the dosing container 25. This is possible especially when the fiber type material is not destroyed by the water flowing past the material outside the container. The dosing container 25 in the example embodiment is constructed as a felt marker which is replaced by a new dosing container 25 after the liquid effective substance has been used up.

The outlet end of the dosing container 25 with the absorbent pin 27 or with the fiber type material 26 extending out of the outlet end may be directed to face the water stream.

FIGS. 9 and 10 show a further handle 1 according to the invention which, according to FIG. 8 has on its inner wall radially inwardly directed ribs 12 which hold centrally therebetween a cartridge type dosing container 29 which is shown in section inside the handle in FIG. 9 and a side view of which is shown in FIG. 10.

The dosing container 29 holds inside its hollow inner space a predetermined quantity of a liquid effective substance. The dosing container 29 has at its upper necked down end 30 a central exit opening which is, for example, tightly closed by an aluminum foil 31. The initially tightly closed dosing container 29 is inserted into the handle as is illustrated in FIG. 9. The handle has, for this purpose, an especially constructed closure cap 32 which may be coupled with its upper end to a cleaning and/or massaging device not shown. The closure cap 32 may be screwed to the handle 1. FIG. 11 shows a section along section line XI—XI in FIG. 9, whereby it becomes clear, that the lower end of the closure cap 32 comprises a centrally special coupling member 33 having a central opening 35 to which a suction tubing 36 is connected. The outer wall 33' of the coupling member 33 and the opposite inner wall of the closure cap 32 are so constructed, that a Laval type ring nozzle 38 is formed between the walls 33', 37 located opposite each other, whereby the outlet opening 35 of the coupling member 33 is located about in the narrowest zone of the ring nozzle 38.

In order to be able to screw the closure cap 32 to the handle 1 into which the dosing container 29 has already been inserted, the aluminum cover 31 is penetrated by the tubing 36 of the coupling member 33. To the extend the closure cap 32 is screwed to the handle the neck type end 30 of the dosing container and the coupling member 33 approach each other. The ring surface 39 of the coupling member 33 surrounding the tubing 36 and facing the neck type end 30 is so constructed that it adjoins the neck type end 30 of the dosing container 29 in a cap-like manner, when the closure cap 32 is fully screwed to the handle, whereby the coupling member 33 is connected to the dosing container 29 in a liquid tight manner and the tubing 36 ends closely above the bottom 40 of the dosing container.

The inner cross-section of the tubing 36 is now selected so that the liquid effective substance rises in the tubing out of the dosing container through the capillary forces up to the outlet opening 35 of the coupling member. If a water stream is guided through the handle 1, which stream is supplied through the hose 2 from a pressure source to the handle, the water will flow along the free ring space between the dosing container 29 and the inner wall of the handle 1 to the upper end of the handle, thereby passing through the Laval ring nozzle 38. As a result, reduced pressure is generated in the zone of the exit opening 35 in the narrowest cross-section of the ring nozzle 38. The reduced pressure sucks liquid effective substance out of the tubing, whereby a predetermined quantity of the liquid effective substance is admixed to the water.

The dosing container 29 may also be closed in another manner rather than with an aluminum foil. Thus, a ball may be pressed into the neck 30 for tightly closing the outlet opening. The ball is pushed into the dosing container when it is opened. The tubing 36 for sucking liquid effective substance out of the dosing container may be omitted if the dosing container is filled with a fiber type material 26 according to FIG. 7 and if an absorbent pin 27 in contact with the fiber type material 26 reaches outwardly through the central exit opening 35 of the coupling member 33 into the narrowest cross-section of the Laval ring nozzle 38. A respective embodiment according to the invention is shown in FIG. 12 in which the respective elements of FIGS. 7 and 9 are provided with the same reference numbers. FIG. 12 illustrates that the absorbent pin 27 projects through the opening 35 of the coupling member 33 to about the narrowest cross-section of the Laval ring nozzle 38. The dosing container 26 comprises prior to its insertion into the handle, a protective cap not shown for protecting the absorbent pin 27 extending out of the dosing container. The protective cap is removed prior to screwing the closure cap 32 onto the handle.

Figure 13:
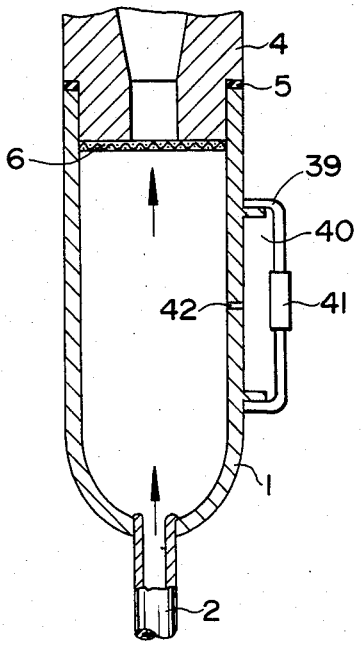

FIG. 13 shows a further embodiment of a handle according to the invention which comprises on its outside a cap type attachment 39 which forms a space 40 between itself and the outer wall surface of the handle 1. The space 40 is accessible by opening, for example, a stopper or screw type closure member 41 in order to fill the space 40 with an effective substance. The space 40 communicates through at least one hole 42 in the wall of the handle with the inside of the handle. In accordance with the water stream flowing through the hollow handle 1 an adjustable small proportion of the effective substance is sucked out of the space 40 into the water stream. The effective substance in this embodiment is liquid. The diameter of the hole 42 is more or less narrow, depending on the viscosity of the liquid. Thus, liquid passes through the hole 42 into the handle only when inside the handle a water stream flows by the hole 42 for entraining liquid effective substance out of the hole 42. The hole 42 may have a less narrow cross-section if the effective substance is relatively viscous. The wall of the attachment 39 or the closure member 41 is provided with a pressure equalization bore for equalizing the pressure.

We claim:

1. In a hollow handle for a fluidic personal care device, which handle carries the personal care device at an upper handle end and which is connected with its opposite handle end to a flexible water hose through which water under pressure is supplied to the fluidic personal care device for delivering through the hollow handle at least one water jet, the improvements comprising: a hollow, enlongated dosing container for holding a supply of an effective substance, said dosing container being insertable into said hollow handle and having a closed bottom end and an open top end forming a leaking opening, at least one first flow passage defined between an outer wall of said dosing container and an inner wall of the hollow handle, a closure cap having an inner end and an outer end and a central flow channel through said closure cap which is secured to said upper handle end, connecting means for said closure cap to connect the closure cap to said personal care device, a flow interaction region forming an annular space on the inner end of said closure cap around said flow channel between said closure cap and said open end of said handle with said dosing container inserted in said handle, at least one second flow passage connecting said first flow passage to said flow interaction region, said flow interaction region being formed such that water flow from said second flow passage into said interaction region causes the effective substance to dissolve generally in the range of said leaking opening by vortex flow, wherein a flow velocity in at least one of said flow passages is slower than in said interaction region, a screen secured to said closure cap for covering said flow channel, said screen being located opposite to said leaking opening of said dosing container in said handle, said screen having a central part spaced from an inlet opening of said flow channel, said screen having edges held in said annular space for retaining said effective substance, thereby preventing it from closing said flow channel, when said effective substance is moved by water flow toward said central part of said screen, first spacer means located between said inner end of said closure cap and said open top end of said dosing container, second spacer means located between an inner wall of said handle and an outer wall of said dosing container, said second spacer means forming at least one of said first flow passages for the flow of water between the inner wall of the handle and the outer wall of the dosing container, and wherein the cross-sectional area of said first flow passage is smaller than the free cross-sectional area of said water hose at said opposite handle end and the pressure of the water flow in said first flow passage is greater than the pressure of the water flow in said interaction region.

2. The handle of claim 1, further comprising further spacer means at the top end of the dosing container.

3. The handle of claim 1, wherein said second spacer means comprise projections between the outer wall of the dosing container and the inner wall of the handle, said projections being uniformly distributed over the circumference of the dosing container.

4. The handle of claim 1, wherein said second spacer means comprise small ribs generally extending along the elongated outer wall of said dosing container.

5. The handle of claim 1, wherein said second spacer means comprise small ribs on the inner wall of said handle.

6. The handle of claim 1, wherein said second spacer means comprise small ribs on the outer surface of said dosing container.

7. The handle of claim 1, wherein said dosing container is provided with at least one perforation in said outer wall of said dosing container.

8. The handle of claim 7, wherein the size of said at least one perforation is determined by the selected solution quantity of said effective substance.

9. The handle of claim 1, wherein said dosing container is provided with at least one perforation in its outer wall, except in said closed bottom of said dosing container.

10. The handle of claim 1, further comprising at least one perforation in said outer wall of said dosing container outside of said second spacer means.

11. The handle of claim 1, wherein said dosing container generally has a cylindrical inner space for holding the effective substance and wherein said cylindrical inner space has a diameter which is slightly larger than the outer diameter of said effective substance before coming into contact with water.

12. The handle of claim 1, wherein said effective substance is a rod-like body, the water stream flowing from said interaction region out of said flow channel of said closure cap causing a suction effect against said leaking opening so that the rod-like effective substance may move out of the dosing container against said screen.

13. The handle of claim 1, wherein at least one perforation in the dosing container is sized and shaped such that water flowing through said perforation into said dosing container may cause said effective substance to move against the central part of said screen.

14. A handle for a fluidic cleaning and/or massaging device, which handle carries the cleaning and/or massaging device at its upper end and which is connected with its opposite end to a flexible water hose, through which water under pressure is supplied to the fluidic device for delivering through the hollow handle at least one cleaning and/or massaging jet, characterized in that a flow guide body is inserted rigidly into the handle, said flow guide body being adapted to the free inner cross-section in the lower end of the handle, said flow guide body being provided for holding a solid effective substance in the form of a rod or in the form of a stack of tablets of about the same size, said flow guide body having projections distributed about its circumference which form flow through passages between the projections and an inner wall of the handle for the pressurized water supplied through the hose, and that the flow guide body forms a support surface for the solid effective substance inserted in the handle, said flow guide body further forming a protective closed surface for an upstream facing surface of the effective substance which is directed against the water stream.

* * * * *